United States Patent [19]

Litz

[11] Patent Number: 4,965,022

[45] Date of Patent: Oct. 23, 1990

[54] PROCESS FOR DISSOLVING A GAS IN A LIQUID

[75] Inventor: Lawrence M. Litz, Pleasantville, N.Y.

[73] Assignee: Union Carbide Industrial Gases Technology Corporation, Danbury, Conn.

[21] Appl. No.: 465,409

[22] Filed: Jan. 16, 1990

Related U.S. Application Data

[63] Continuation of Ser. No. 68,529, Jul. 1, 1987, abandoned.

[51] Int. Cl.[5] ..... B01F 3/04

[52] U.S. Cl. ..... 261/36.1; 261/76; 261/DIG. 75

[58] Field of Search ..... 261/DIG. 75, 36.1, 76

[56] References Cited

U.S. PATENT DOCUMENTS

| | | | |
|---|---|---|---|
| 2,102,042 | 12/1937 | Spence | 261/DIG. 75 |
| 2,413,102 | 12/1946 | Ebert et al. | 261/DIG. 75 |
| 2,521,215 | 9/1950 | Haddeland et al. | 261/28 |
| 3,476,366 | 11/1969 | Brooks et al. | 261/36.1 |
| 4,162,971 | 7/1979 | Zlokarnik | 261/DIG. 75 |
| 4,304,665 | 12/1981 | Hines | 261/121.1 |
| 4,333,833 | 6/1982 | Longley et al. | 261/DIG. 75 |
| 4,351,730 | 9/1982 | Bailey et al. | 261/36.1 |
| 4,411,780 | 10/1983 | Suzuki et al. | 261/DIG. 75 |
| 4,416,781 | 11/1983 | Bailey et al. | 261/36.1 |
| 4,417,985 | 11/1983 | Keane | 261/123 |
| 4,466,928 | 8/1984 | Kos | 261/DIG. 75 |
| 4,597,877 | 7/1986 | Gaia | 261/DIG. 75 |
| 4,664,680 | 5/1987 | Weber | 261/36.1 |

FOREIGN PATENT DOCUMENTS

| | | | |
|---|---|---|---|
| 2447337 | 4/1976 | Fed. Rep. of Germany | 261/DIG. 75 |
| 694918 | 7/1953 | United Kingdom | 261/DIG. 75 |
| 1239727 | 7/1971 | United Kingdom | 261/DIG. 75 |

OTHER PUBLICATIONS

American Heritage Dictionary, Apr. 1982, Houghton Mifflin Co., p. 407.

"Session III Water Conditioning for Fish Rearing, Management of Dissolved Oxygen and Nitrogen in Fish Hatchery Waters", R. E. Speece, Drexel University, Philadelphia, Pa., pp. 53–62, American Fisheries Society Meeting (1984).

"Modeling Gas Transfer in a U-Tube Oxygen Absorption System: Effects of Off-Gas Recycling", Aquacultural Engineering 4 (1985) pp. 271, 274–297, B. J. Watten et al., Pennsylvania Power and Light Co., Dept. of Technology and Energy Assessment, Brunner Island Aquaculture Project, York Haven, Pa.

*Primary Examiner*—Tim Miles

*Attorney, Agent, or Firm*—A. H. Fritschler

[57] ABSTRACT

The pump energy requirements for the dissolving of a gas in a liquid are significantly reduced by injecting gas bubbles into a stream of said liquid at a relatively low pressure, utilizing a pressure head of liquid to increase the solubility of the gas in the liquid, and employing liquid stream velocities and gas-liquid contractor diameters and lengths, gas dispersion means and residence times such as to obtain a desired level of gas concentration in the liquid.

35 Claims, 2 Drawing Sheets

PROCESS FOR DISSOLVING A GAS IN A LIQUID

This application is a continuation of prior U.S. application Ser. No. 068,529, filed July 1, 1987, now abandoned.

BACKGROUND OF THE INVENTION

1. Field of the Invention

The invention relates to the dissolving of a gas in a liquid. More particularly, it relates to the reduction of the energy requirements associated with such dissolution.

2. Description of the Prior Art

Pipe line contactors are well known as means for dissolving gases in and/or reacting gases with liquids. Such contactors are often employed to increase the dissolved oxygen content of water or process liquids. Organic material in plant waste streams, e.g., paper mills and chemical plants, often leads to a need for such an increase in dissolved oxygen content before the discharge of such waste streams in a body of water. A similar need may also occur at municipal waste treatment plants. Fish farms often require increased dissolved oxygen levels to satisfy the needs of high density aquaculture. Pipe line contractors have been used for such gas dissolution operations, in desirable side-stream systems, wherein a fractional volume of a liquid stream is removed as a side-stream, pressurized, highly gasified and then mixed back into the primary stream of liquid.

Typically in side-stream pumping systems, such gas dissolution processes are operated at high pressures to increase the rate of dissolution of the gas in the liquid. In addition, such high pressure operation increases the dissolved gas content levels achievable in such processes. High energy pumps are normally used to generate the high pressures at which it is desirable to carry out the gas dissolution processes.

There is, of course, a general desire in the art to improve the efficiency of industrial processing operations. With respect to the subject gas dissolution processes, it would be desirable to reduce the energy requirements thereof. Such an energy reduction, in turn, would serve to facilitate the carrying out of useful gas dissolution operations that might otherwise be detered by the relatively high energy costs typically associated therewith.

It is an object of the invention, therefore, to provide an improved process for the dissolution of gases in, and/or the reacting of gases with, liquids.

It is another object of the invention to provide a process capable of reducing the energy requirements associated with the dissolution of gases in liquids.

With these and other objects in mind, the invention is hereinafter described in detail, the novel features thereof being particularly pointed out in the appended claims.

SUMMARY OF THE INVENTION

The invention combines the use of a pressure head of liquid, such as to significantly increase the solubility of gas in a liquid stream, with liquid stream velocities, gas-liquid contactor diameters and lengths, residence times of the liquid stream containing dispersed gases in the contactor, and gas dispersion conditions, to obtain the desired level of dissolved gas concentration in the liquid stream recovered from the contactor. Significant savings in pump energy costs are achieved in the practice of the invention, conveniently employing a vertical pipe line contactor positioned in a wellbore.

BRIEF DESCRIPTION OF THE DRAWINGS

The invention is hereinafter further described with reference to the accompanying drawings in which.

DETAILED DESCRIPTION OF THE INVENTION

Figure 1:
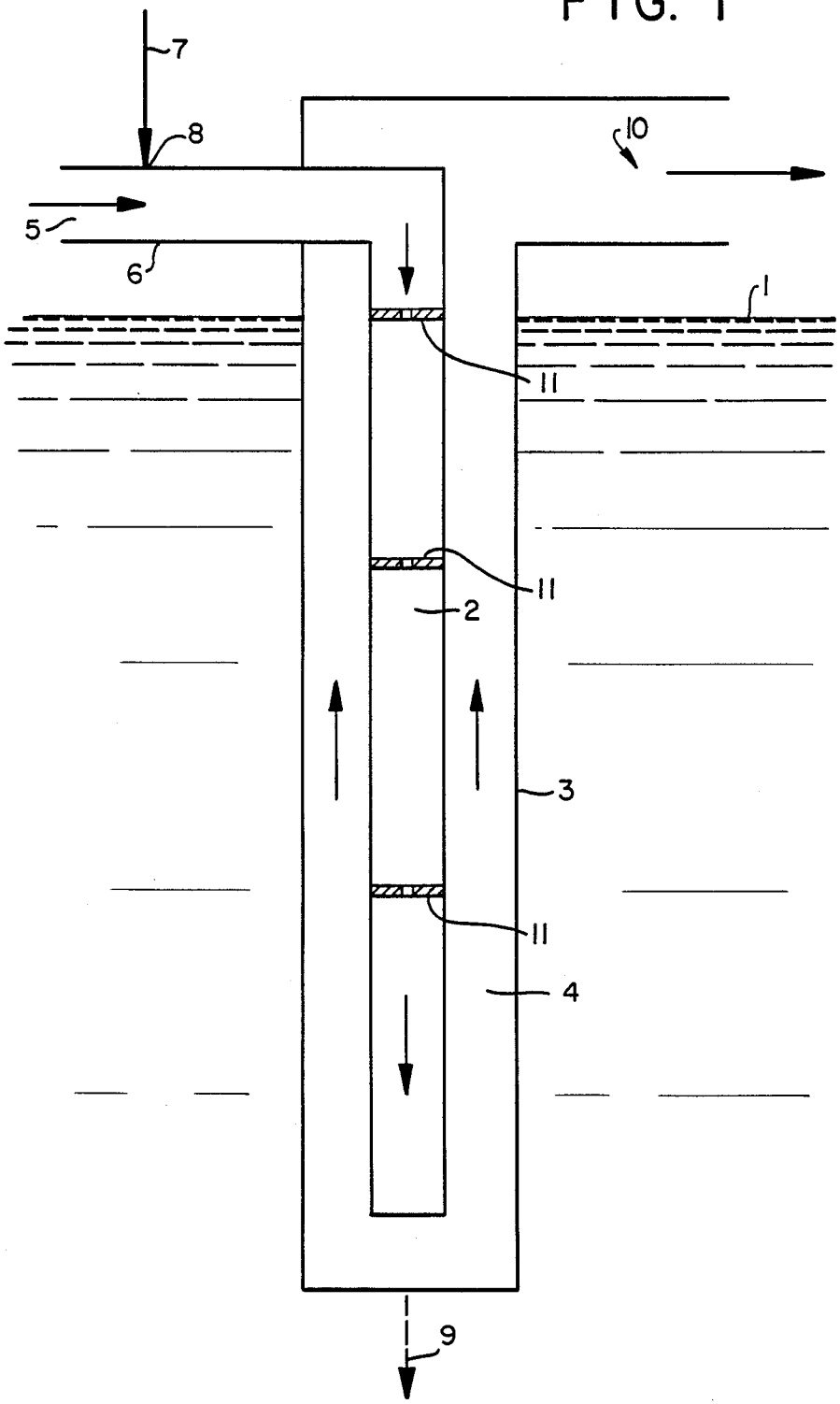
FIG. 1 is a schematic drawing of an embodiment of the invention in which a liquid stream containing gas bubbles is passed in a downward flow path through an inner conduit with subsequent upward flow in the annular space between the inner conduit and an outer casing.

The objects of the invention are accomplished by a novel combination of processing features that enable the desired gas dissolution to be accomplished at desirably low energy requirements and enhances overall processing efficiency. A liquid stream containing dispersed gas bubbles at a relatively low initial pressure is exposed to increasing pressure under conditions assuring that a uniform dispersion of fine gas bubbles is maintained, while the solubility and dissolution rate of the gas in the liquid is increased. Such conditions are maintained for a sufficient residence time under desired flow rate conditions such that a liquid stream having the desired dissolved gas concentration level is recovered at the prevailing temperature and pressure conditions at the point of recovery.

The dissolved gas concentration of the recovered liquid stream will, of course, be greater than the dissolved gas concentration of the initial gas dispersion formed at said low pressure in the practice of the invention. The liquid stream thus treated is conveniently a side-stream, as referred to above, of a primary stream of liquid in which the gas is to be dissolved under advantageous processing conditions.

In the gas dissolution process of the invention, the gas to be dissolved is injected into a stream of the liquid in question to form an initial dispersion of gas bubbles in the liquid. This gas injection step is carried out at an initial, relatively low pressure and may be accompanied by some small amount of initial dissolution of the gas in the liquid stream. The resulting liquid stream containing said gas bubbles is passed in a generally downward flow path from the elevation level at which said gas injection is carried out. During this downward flow path, the pressure on the liquid stream will be understood to increase because of its increasing hydrostatic head. This increased pressure of the liquid stream will, in turn, increase the solubility and the dissolution rate of the gas in the liquid.

The desired gas dissolution is enhanced by maintaining the gas bubbles uniformly dispersed in the liquid stream, advantageously in the form of very fine bubbles having appreciably larger surface areas exposed to the liquid than is the case when relatively large sized bubbles are formed. To assure such uniform dispersion of gas bubbles, desirably of fine gas bubbles, in the liquid stream, and enhanced gas dissolution, the liquid stream is exposed to suitable gas dispersion conditions during its passage through said downward flow path. Such gas dispersion conditions, as disclosed in further detail below, may comprise flow restriction means positioned in the downward flow path. Alternately, turbulent flow conditions such as to enhance the uniform dispersion of fine gas droplets, and the dissolution of the gas in the liquid, can be created by the use of relatively high liquid flow velocities, without the need for incorporating flow restriction means in the liquid flow path.

The liquid stream containing dissolved and dispersed gas is continued to be passed in said downward flow path under the conditions indicated above to cause increasing amounts of the gas to be dissolved in said liquid. For this purpose, the liquid stream is passed in said downward flow path for a residence time, as determined by the diameter and length of said flow path and by the flow rate of said liquid stream, such that an advantageous dissolved gas concentration level is obtained at the end of said downward flow path. It will be appreciated that at relatively low flow rates, the length of the downward flow path can be made shorter, for a given flow path diameter, than is required at relatively high flow rates. In any event, the liquid stream containing dissolved gas, and any residual dispersed gas bubbles, can be recovered at a desired dissolved gas concentration level at the prevailing temperature and pressure at a desired point of recovery, with the gas dissolution operation having been enhanced by the combination of processing features referred to above with respect to the passage of said liquid stream through said generally downward flow path.

In one embodiment of the invention, the liquid stream containing dissolved gas at the desired level is recovered at a point of recovery essentially at the lower end of the downward flow path. In other embodiments, the liquid stream containing dissolved gas and any residual gas bubbles is passed from the lower end of said downward flow path in a generally upward additional flow path to a desired point of recovery. In such latter embodiments, the residence time of said liquid stream in the upward additional flow path is such that, at the point of recovery of the liquid stream from said upward additional flow path, the recovered liquid has the desired dissolved gas concentration at the prevailing temperature and pressure at said point of recovery. Such residence time of the liquid in the upward additional flow path is determined by the diameter and length of said upward additional flow path and by the flow rate of said liquid stream therein. In one convenient embodiment of the invention, the downward flow path is through an inner conduit surrounded by an outer casing. The liquid stream containing dissolved gas and any residual gas bubbles is passed upward in the annular space between the inner conduit and said outer casing. In a particularly convenient and preferred embodiment, the inner conduit and outer casing are positioned in a wellbore, with the gas being injected into the liquid at groundlevel for passage into the wellbore through said inner conduit. The liquid having the desired dissolved gas concentration is recovered from the annular space, also conveniently at groundlevel. It will be understood that the liquid could also be passed downward through said annular space, with recovery of liquid containing the desired dissolved gas concentration being made from the inner conduit, conveniently at groundlevel.

In another embodiment of the invention, the downward flow path and the upward additional flow path comprise a conduit loop having inlet and discharge ends at upper levels, e.g., at or above groundlevel, with said conduit loop having an intermediate portion of the flow path at a lower elevation. While the process of the invention is preferably employed using a downward flow path and upward additional flow path in which the inlet and discharge ends are essentially at the groundlevel of a wellbore, it is also feasible to employ a downward flow path that is positioned essentially above ground. For example, it may be convenient in some embodiments to employ a downward flow path in a conduit positioned against or near a building or other structure with the gas to be dissolved into a liquid stream being conveniently injected into the stream of liquid at the upper level of said conduit for passage downward therein to a lower elevation, e.g., at groundlevel. In such instances, it will be understood that the liquid stream containing dissolved gas and any residual gas bubbles is passed upward from said lower elevation to a higher level in an upward additional flow path, as in the annular space between said conduit and an outer casing.

It will also be appreciated that similar benefits can be achieved by passing the liquid, having the gas to be dissolved injected therein to form an initial dispersion of gas bubbles in said liquid, initially in a generally upward flow path from the lower portion of a hydrostatic head of liquid, with or without a subsequent downward additional flow path. The pressure head is initially high due to the hydrostatic head of liquid at the lower end of the flow path. Under circumstances in which the flow path comprises a continuous body of liquid, the pumping energy requirements of the process can be minimized. In such process variations, the highest rate of solution and the highest gas solubility are achieved at the beginning of the flow path, i.e. at the start of the initial generally upward flow path, and the flow path can be made desirably shorter than in various other process configurations. Such process variations are particularly desirable in cases in which the column of liquid is positioned above ground. Gas dispersion conditions, gas-liquid contactor diameters and lengths, liquid residence times and the like are employed in such process variations as in cases, such as those described above, in which the liquid stream is initially passed in a generally downward direction. In another useful process variation, the gas to be dissolved is introduced into the liquid in a horizontal flow column, employing said gas dispersion conditions, residence times and the like as above, with a hydrostatic head again being used to provide an increased liquid pressure in said horizontal flow column to increase the gas dissolution rate and the gas solubility in the liquid. In this latter variation, a side stream of liquid can conveniently be withdrawn from the lower portion of a liquid-containing vessel for passage desirably in a horizontal loop flow path corresponding to the flow paths described above. The desired gas can be injected into the liquid, which will have the pressure imposed by the hydrostatic head in said vessel. Gas dispersion conditions, as described herein, can be employed to assure uniform dispersion of gas bubbles and enhanced gas dissolution in the liquid. The passage of the liquid stream containing dissolved and dispersed gas through the generally horizontal flow path is continued for a residence time, as determined by the diameter and length of the flow path and the flow rate of said stream, such that a desired dissolved gas concentration level is achieved at the end of the flow path. It will be appreciated that the horizontal loop flow path conveniently ends with the discharge of the liquid stream containing the desired gas concentration level back into said vessel.

Those skilled in the art will appreciate that various changes and modifications can be made in the details of the process as herein described without departing from the scope of the invention as set forth in the appended claims. For example, while various liquid flow rates can be employed, it is often desirable that the liquid flow rate in the downward flow path be maintained at only slightly above the nominal rise velocity of gas bubbles within the liquid. In this manner, the length of said downward flow path can be kept desirably short for a given residence time. In addition, it is generally desirable that the length and diameter of the upward additional flow path, and the upward flow rate of the liquid stream, are such that the gas concentration at the upper end of said upward additional flow path does not exceed the saturation concentration of the gas in the liquid at the temperature and pressure conditions prevailing at the upper end of the flow path. Under this condition, the oxygen or other gas utilization of the process is maximized and the length of the flow path is advantageously minimized.

As noted above, the gas dispersion conditions to which the liquid stream is exposed in the downward flow path can comprise flow restriction means positioned in said flow path. Those skilled in the art will appreciate that said flow restriction means can be an orifice, a venturi section of said flow path, a perforated baffle plate or any other such mechanical configuration or equivalent means known in the art for creating turbulence or like conditions such as to ensure a uniform dispersion of the gas bubbles in the liquid stream during passage through said downward flow path. It will also be appreciated that such flow restriction means are desirably spaced along the length of said downward at convenient intervals to assure that the uniform dispersion of fine gas bubbles and enhanced gas dissolution are maintained throughout the length of the flow path.

As an alternative to the incorporation of flow restriction means in the downward flow path, the gas dispersion conditions to which the liquid stream is exposed can comprise turbulent flow conditions created by passing the liquid stream through the flow path at a velocity of at least about 8 feet per second, preferably at a velocity of at least about 10 feet per second. Such turbulent conditions likewise assure that the gas bubbles in the liquid stream are uniformly dispersed, advantageously as fine bubbles, for enhanced gas dissolution. It will be appreciated that the velocity of the liquid stream, to maintain such turbulent flow conditions, can be at any suitable velocity higher than the velocities referred to above depending upon the overall conditions pertaining to any given gas dissolution operation. Higher velocity conditions will be understood to generally require that the flow path length and/or diameter be made appreciably greater than is required for lower velocity operations.

In embodiments employing both a downward flow path and an upward additional flow path, it will be understood that, although the dissolved gas concentration at the lower end of the downward flow path may be such that gas dispersion conditions need not be employed in the upward additional flow path, such gas dispersion conditions will commonly be employed in said upward additional flow path as well as in the downward flow path. The gas dispersion conditions employed in the upward additional flow path can be either the flow restriction conditions or the turbulent flow conditions as discussed above with respect to the downward flow path. It is within the scope of the invention to employ either the same or different gas dispersion conditions in the separate portions of the overall flow path. In one desirable embodiment, for example, flow restrictions can be positioned in the downward flow path and in the upward additional flow path at conveniently spaced intervals, e.g., at 30–40 foot intervals. In this embodiment, the flow velocities in the separate portions of the overall flow path and the size of the downward and upward additional flow paths, i.e., the length and diameter or cross-sectional area thereof, can be maintained desirably small. It will be further understood that the liquid velocity in the upward additional flow path can be the same or different than that in the downward flow path. In the preferred embodiment in which the downward flow path is in an inner conduit positioned in a wellbore, the cross sectional area of the annular space between said inner conduit and an outer casing can either be the same as that of said inner conduit, or either greater or less than said area of the inner conduit.

The invention will thus be seen to combine the use of a pressure head of liquid, such as to significantly increase the solubility and dissolution rate of gas in a liquid stream, with liquid stream velocities, gas-liquid contactor diameters or cross-sectional areas and lengths, residence times of the liquid stream containing dispersed gases in the contactor, and gas dispersion means, to obtain the desired level of dissolved gas concentration in the liquid stream recovered in the process. Significant savings in pump energy costs are achieved in the practice of the invention, with the benefits of the invention being particularly enhanced by the use of a vertical pipe line contactor positioned in a wellbore.

The rate of dissolution of gas in liquid, e.g., of oxygen in water, is proportional to the driving force for the desired solution and to the specific interfacial area of gas bubbles in a particular gas dissolution operation. The driving force for the solution is defined by the term ($C_S$–C), where $C_S$ is the gas solubility or gas saturation at the temperature and pressure of the liquid and C is the dissolved gas concentration at any given point of the flow path. Since the gas solubility increases as the liquid passes downward and is greatest at the lower and of the downward flow path, it will be seen that the difference between the gas saturation and the dissolved gas concentration of the liquid passing down said flow path establishes a generally increasing rate of dissolution in said downward flow path. In the upward additional flow path, on the other hand, the gas solubility of the liquid is reduced as the hydrostatic pressure head decreases upon passage of the liquid upward through the upward additional flow path. As a result, the difference between the gas saturation and the dissolved gas concentration of the liquid passing through said upward additional flow path establishes a generally decreasing rate of dissolution in said upward additional flow path.

The rate of dissolution of the gas in the liquid is also proportional to the specific interfacial area of gas bubbles. Thus, the gas dispersion conditions referred to above, which provide for the formation of very fine bubbles of high surface area and the precluding of the growth of large size bubbles of relatively low surface area, assure that the interfacial area of the gas bubbles contribute to the desired rate of dissolution of the gas in the liquid. Because of the difficulty in measuring the actual size of the bubbles in practical systems, the interfacial area is conveniently combined with the mass transfer coefficient as a measure of the mass transfer characteristics of a given gas-liquid system. This combined factor can be determined fairly readily in practice. It will be appreciated that its value can vary substantially depending upon the gas dispersion characteristics of each particular system and the amount of gas employed. In pipe line contactors, the amount of the free gas decreases from the inlet to the discharge end due to the gas going into solution in the liquid. Therefore, the measured mass transfer characteristics comprises an average for a particular system design. The dissolution capabilities determined therefrom should be considered as a good approximation, but not necessarily exact. For this reason, an overdesign factor of 10% to 20% is desirably employed. The residence time required to achieve a desired dissolved gas concentration is relative to the quantities ($C_s$–$C_o$) and ($C_s$–$C_f$) where $C_o$ is the gas concentration of the liquid stream entering the contactor, $C_f$ is the concentration of said liquid exiting said contractor, and $C_s$ is as referred to above, and to the gas-liquid surface area and mass transfer characteristics referred to above. In the practice of the invention, $C_s$ is increased at the lower end of the downward flow path over the $C_s$ value at the upper end thereof, whereby residence times are reduced to achieve a desired dissolved gas concentration in the liquid stream and the energy requirements of the process are minimized.

With reference to the drawings, FIG. 1 illustrates an embodiment of the invention in which the downward and upward flow paths are positioned in a wellbore, with the initial injection of the gas to be dissolved into a stream of liquid occurring at an initial relatively low pressure above the ground level referred to by the numeral 1. The downward flow path of the liquid having gas bubbles dispersed therein is through inner conduit 2 surrounded by outer casing 3. The liquid stream containing dissolved gas and any residual gas bubbles is passed upward in annular space 4 between inner conduit 2 and outer casing 3. As indicated above, such inner conduit and outer casing are positioned in a wellbore, not shown, but which can extend below the bottom portion of outer casing 3. A stream of liquid 5 is passed through above ground conduit 6 to inner conduit 2 for downward passage therein. The gas to be dissolved in the liquid is passed through line 7 for injection through conventional gas injection means 8 into said liquid stream in conduit 6 at relatively low pressure, so that the liquid stream has gas bubbles dispersed therein upon its passage in the downward flow path through inner conduit 2. The liquid stream containing dissolved gas at a desired level, in some embodiments, will be recovered at the lower end of the downward flow path, as by discharge through line 9. In the illustrated embodiment, however, the liquid stream containing dissolved gas and any residual gas bubbles is passed upward in annular space 4 for recovery above ground level, at a desired gas concentration level, through discharge line 10.

During the downward passage of the liquid-gas bubble stream in inner conduit 2, the pressure on the liquid stream increases because of its increasing hydrostatic head, increasing the solubility and dissolution rate of the gas in the liquid as noted above. To assure uniform dispersion of fine gas bubbles in the liquid stream for enhanced gas dissolution, the liquid stream is exposed to gas dispersion conditions in inner casing 2 by the suitable placement of flow restriction means in the form of orifice plates 11 at spaced intervals along the downward flow path therein. Such orifice plates create turbulence in the downward flow path such as to ensure a uniform dispersion of gas bubbles in the liquid stream during its passage through said downward flow path. The placement of said orifice plates 11 are such as to assure that the uniform dispersion of fine gas bubbles, and enhanced gas dissolution, are maintained throughout the length of the downward flow path.

The liquid flow rate through inner casing 2, wherein spaced apart orifice plates 11 assure uniform dispersion of gas bubbles and enhanced gas dissolution in the liquid throughout the downward flow path therein, can be maintained at a rate only slightly above the minimal rise velocity of gas bubbles in the liquid. Such relatively low liquid flow rate enables the length of the inner casing to be kept desirably short for a given residence time within said downward flow path. The length and diameter of the upward flow path in annular space 4, and the upward flow rate of liquid therein, are maintained such that the liquid stream recovered through discharge line 10 contain dissolved gas and any residual dispersed gas bubbles at a desired dissolved gas concentration level at the prevailing temperature and pressure at said discharge line 8. This gas concentration at the point of recovery will be greater than the dissolved gas concentration level at the beginning of the downward flow path.

As disclosed above, orifice plates 11 or other mechanical flow restriction means need not be employed if the gas dispersion conditions to which the liquid stream is exposed comprise turbulent flow conditions created by liquid velocities in excess of at least about 8 feet per second, preferably at least about 10 feet per second. Such turbulent conditions likewise assure the uniform dispersion of gas bubbles for enhanced gas dissolution. Gas dispersion conditions are commonly employed in the upward flow path as well as in the downward flow path. Such gas dispersion conditions in the upward flow path can comprise either flow restriction conditions of the turbulent flow conditions referred to above. In the FIG. 1 embodiment, no flow restriction conditions, such as orifice plates 11 in the downward flow path, are employed. The diameter and length of annular space 4, together with the flow rate of liquid upward therein, will thus be such that the residence time of the liquid in the upward flow path enables the liquid stream to be recovered in discharge line 10 with a desired gas concentration at the prevailing temperature and pressure at said point of recovery.

Figure 2:
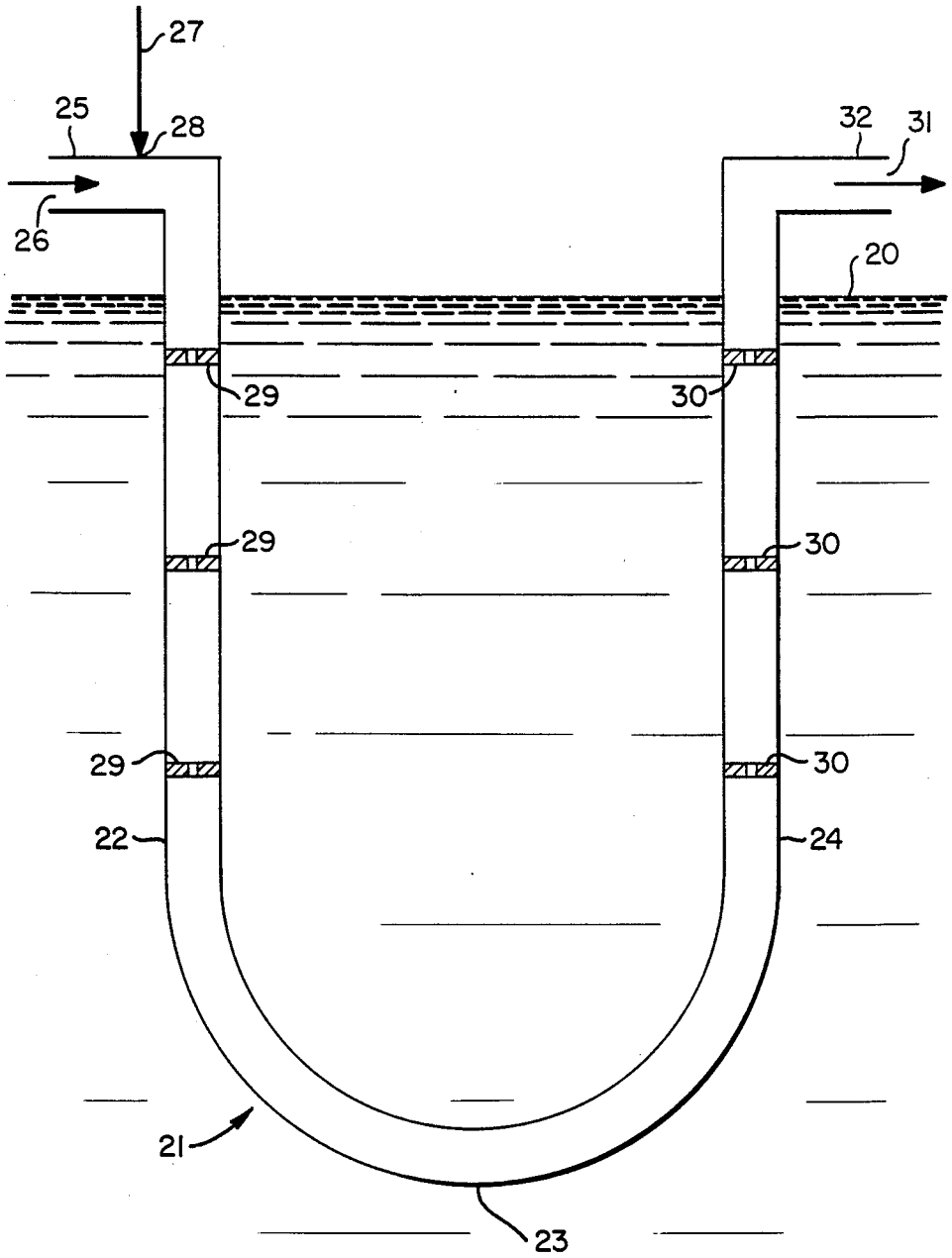
FIG. 2 is a schematic drawing of another embodiment of the invention in which a liquid stream containing gas bubbles is passed in a downward flow path with subsequent upward flow in a conduit loop having inlet and discharge ends at upper locations and an intermediate portion of said flow path at a lower elevation.

FIG. 2 illustrates another embodiment of the invention in which the inlet and discharge ends of the flow paths are above ground level 20 and said flow paths comprise a conduit loop 21 having a generally downward flow path section 22, an intermediate section 23, and a generally upward flow path section 24. Liquid inlet line 25 is employed to pass a liquid stream 26 to the upper inlet end of downward flow path section 22, and gas from gas supply line 27 is injected into the liquid stream in inlet line 25 through conventional gas injection means 28 at relatively low pressure. Orifice plates 29 are positioned at spaced intervals along the length thereof, throughout downward flow path section 22, and orifice plates 30 are positioned at spaced intervals in upward flow path section 24. The operation of the FIG. 2 embodiment will be understood to be similar to that described with respect to FIG. 1. Thus, the orifice plates serve to ensure that the gas bubbles present in the liquid stream flowing through conduit loop 21 are uniformly dispersed, preferably in the form of fine bubbles, along the downwardly and upwardly extending flow path for enhanced gas dissolution. The flow rate of liquid through conduit loop 21, and like length and diameter of said loop and of the sections thereof, are such that an advantageous dissolved gas concentration level is reached at the end of like downward flow path in section 22 and that liquid stream 31 is recovered through discharge line 32 at a desired dissolved gas concentration level at the prevailing temperature and pressure at the point of recovery through said discharge line 32. The gas concentration of liquid stream 31 in said discharge line 32 is greater than the dissolved gas concentration level at the point at which the liquid stream passed from liquid inlet line 25 into the upper inlet end of downward flow path section 22 of conduit loop 21.

In an illustrative example of the practice of the invention, it is desired to oxygenate water available at a fish farm, and a primary stream of water is withdrawn from a fish pond for this purpose. A side stream, i.e. about 10% of the primary stream, is injected into a 12" central conduit positioned in a 16" wellbore casing, the well having a depth of about 180 feet. The initial concentration of oxygen in the water is approximately zero, and oxygen gas is injected into said side stream of water at an initial pressure of about 30 psia under ambient temperature conditions. The solubility of oxygen i.e. the oxygen saturation concentration, at the initial conditions is about 80 ppm. The oxygen injected at said initial, relatively low pressure forms a dispersion of oxygen gas bubbles in the liquid. As the water in said side stream, and containing oxygen gas bubbles, is passed downward through the central conduit, the pressure on the liquid is increasing due to gravity, thereby increasing the oxygen solubility and the dissolution rate of the oxygen bubbles in the water. The flow velocity of liquid is about 2.5 feet per second in the central inner conduit and in the circular space between said conduit and the outer casing. Orifice plates are positioned at ground-level and at well depths of about 60 and 120 feet within said inner conduit to create desired gas dispersion conditions. In this example, no such flow restriction means are positioned in the upward flow path in the annular space, which has a cross-sectional area approximately equal to that of the inner conduit. The pressure at the bottom of the downward flow path is 120 psia, at which point the oxygen gas saturation level is 320 ppm. Treated water recovered at the discharge end of the upper additional flow path in said annular space has a dissolved oxygen concentration of 50 ppm, the pressure of said water being about 24 psia and the gas solubility at the prevailing pressure and ambient temperature conditions being close to 80 ppm. The pumping energy requirements required to achieve such desirable oxygen dissolution are found to be appreciably reduced to about 25% of said energy requirements required in achieving such oxygen dissolution in a typical horizontal, surface side-stream process.

The dissolution of oxygen in water, as described above with respect to an advantageous down hole oxygen dissolver embodiment of the invention, will be seen as an illustrative embodiment of the improved process of the invention for the dissolving of a gas in a liquid. Those skilled in the art will appreciate that the process of the invention can be employed for a wide variety of other commercially desirable gas dissolution operations. The dissolution of oxygen in a waste stream, or in a side stream thereof, or the dissolution of chlorine or carbon dioxide in water or other liquid, are other illustrative examples of the useful application of the invention.

The mention of a very significant benefit in the art, enabling gas dissolution operations to be carried out at advantageously low pumping energy requirements and overall processing efficiency. The invention thus enhances the technical and economic feasibility of carrying out a wide variety of desirable gas dissolution operations in practical commercial applications.

I claim:

1. An improved process for dissolving a gas in a liquid comprising:

(a) injecting the gas to be dissolved into a stream of said liquid at an initial, relatively low pressure to form a dispersion of gas bubbles in said liquid;

(b) passing said liquid stream containing gas bubbles in a generally downward flow path, thereby increasing the pressure on said liquid, thereby increasing the solubility and the dissolution rate of the gas in the liquid;

(c) exposing said liquid stream to flow restriction means located within the internal portion of said stream throughout its passage through said downward flow path to assure uniform dispersion of gas bubbles, and enhanced gas dissolution, in said liquid stream throughout said downward flow path, said flow restriction means being positioned at spaced intervals along the length of said downward flow path;

(d) continuing the passage of said liquid stream containing dissolved and dispersed gas in said downward flow path containing said flow restriction means for a residence time, as determined by the diameter and length of said downward flow path and the flow rate of said stream, to facilitate said dissolving of the gas in the liquid; and (e) recovering said liquid stream containing dissolved gas and any residual dispersed gas bubbles at the prevailing temperature and pressure at a point of recovery, the dissolved gas concentration of the recovered liquid stream being greater than the dissolved gas concentration level at the beginning of said downward flow path, whereby the desired gas dissolution can be accomplished with desirably low pump energy requirements and enhanced overall process efficiency.

2. The process of claim 1 in which said liquid stream containing dissolved gas is recovered at a point of recovery essentially at the lower end of the downward flow path.

3. The process of claim 1 in which the liquid flow rate in said downward flow path is maintained at only slightly above the nominal rise velocity of gas bubbles within said liquid, whereby the length of said downward flow path can be desirably short for a given residence time.

4. The process of claim 1 in which said gas comprises oxygen and said liquid comprises water.

5. The process of claim 1 in which said gas comprises chlorine and said liquid comprises water.

6. The process of claim 1 in which said gas comprises carbon dioxide and said liquid comprises water.

7. The process of claim 1 in which said liquid stream is a side stream of a body of liquid in which the gas is to be dissolved.

8. The process of claim 7 in which said gas comprises oxygen and said body of liquid comprises a waste stream to which the addition of oxygen-rich liquid is desired.

9. The process of claim 7 in which said gas comprises oxygen and said body of liquid comprises a fish pond to which the supply of additional oxygen is desired.

10. The process of claim 1 in which said liquid stream containing dissolved gas and any residual gas bubbles is passed from the lower end of said downward flow path in a generally upward additional flow path to the point of recovery, the residence time of said liquid time in said upward additional flow path, as determined by the diameter and length of said upward additional flow path, and the flow rate of said liquid stream therein being such that the liquid stream, at the point of recovery from said upward additional flow path, has the greater dissolved gas concentration at the prevailing temperature and pressure at said point of recovery.

11. The process of claim 10 in which said downward flow path and said upward additional flow path comprise a conduit loop having inlet and discharge ends at upper elevations, with an intermediate portion of said flow path at a lower elevation.

12. The process of claim 10 in which said downward flow path is through an inner conduit surrounded by an outer casing, said liquid stream containing dissolved gas and any residual gas bubbles passing upward in the annular space between said inner conduit and said outer casing.

13. The process of claim 12 in which said inner conduit and outer casing are positioned in a wellbore, with said gas being injected into the liquid at groundlevel for passage into the wellbore through said inner conduit.

14. The process of claim 12 in which said inner conduit and outer conduit are positioned essentially above ground.

15. The process of claim 10 and including exposing the liquid stream to gas dispersion conditions during its passage through said upward additional flow path.

16. The process of claim 15 in which said gas dispersion conditions to which the liquid stream is exposed during its passage through said upward additional flow path comprise flow restriction means positioned at spaced intervals along the length of said upward flow path.

17. The process of claim 15 in which said gas dispersion conditions to which the liquid stream is exposed in said upward additional flow path comprise turbulent flow conditions created by passing the liquid stream through said upward additional flow path at a velocity of at least about 8 feet per second.

18. The process of claim 17 in which said liquid stream velocity is at least about 10 feet per second.

19. An improved process for dissolving a gas in a liquid comprising:

(a) injecting the gas to be dissolved into a stream of said liquid at an initial, relatively low pressure to form a dispersion of gas bubbles in said liquid;

(b) passing said liquid stream containing gas bubbles in a generally downward flow path, thereby increasing the pressure on said liquid, thereby increasing the solubility and the dissolution rate of the gas in the liquid, the velocity of said liquid stream throughout said downward flow path being at least about 8 feet per second to assure uniform dispersion of gas bubbles, and enhanced gas dissolution, in said liquid stream through out the downward flow path;

(c) continuing the passage of said liquid stream containing dissolved and dispersed gas at said flow velocity throughout said downward flow path for a residence time, as determined by the diameter and length of said downward flow path and the flow rate of said stream to facilitate said dissolving of the gas in the liquid; and (d) recovering said liquid stream containing dissolved gas and any residual dispersed gas bubbles at the prevailing temperature and pressure at a point of recovery, the dissolved gas concentration of the recovered liquid stream being greater than the dissolved gas concentration level at the beginning of said downward flow path, whereby the desired gas dissolution can be accomplished with desirably low pump energy requirements and enhanced overall process efficiency.

20. The process of claim 19 in which the velocity of said liquid stream is at least about 10 feet per second.

21. The process of claim 19 in which said gas comprises oxygen and said liquid comprises water.

22. The process of claim 19 in which said gas comprises chlorine and said liquid comprises water.

23. The process of claim 19 in which said gas comprises carbon dioxide and said liquid comprises water.

24. The process of claim 19 in which said liquid stream containing dissolved gas is recovered at a point of recovery essentially at the lower end of the downward flow path.

25. The process of claim 19 in which said liquid stream is a side stream of a body of liquid in which the gas is to be dissolved.

26. The process of claim 25 in which said gas comprises oxygen and said body of liquid comprises a waste stream to which the addition of oxygen-rich liquid is desired.

27. The process of claim 25 in which said gas comprises oxygen and said body of liquid comprises a fish pond to which the supply of additional oxygen is desired.

28. The process of claim 19 in which said liquid stream containing dissolved gas and any residual gas bubbles is passed from the lower end of said downward flow path in a generally upward additional flow path to the point of recovery, the residence time of said liquid time in said upward additional flow path, as determined by the diameter and length of said upward additional flow path, and the flow rate of said liquid stream therein being such that the liquid stream, at the point of recovery from said upward additional flow path, has said dissolved gas concentration at the prevailing temperature and pressure at said point of recovery.

29. The process of claim 28 in which said downward flow path is through an inner conduit surrounded by an outer casing, said liquid stream containing dissolved gas and any residual gas bubbles passing upward in the annular space between said inner conduit and said outer casing.

30. The process of claim 29 in which said inner conduit and outer casing are positioned in a wellbore, with said gas being injected into the liquid at ground level for passage into the wellbore through said inner conduit.

31. The process of claim 29 in which said inner conduit and outer conduit are positioned essentially above ground.

32. The process of claim 28 and including exposing the liquid stream to gas dispersion conditions throughout its passage through said upward additional flow path.

33. The process of claim 32 in which said gas dispersion conditions to which the liquid stream is exposed during its passage through said upward additional flow path comprise flow restriction means positioned in said flow path.

34. The process of claim 32 in which said gas dispersion conditions to which the liquid stream is exposed in said upward additional flow path comprise turbulent flow conditions created by passing the liquid stream through said upward additional flow path at a velocity of at least about 8 feet per second.

35. The process of claim 34 in which said liquid stream velocity is at least about 10 feet per second.

* * * * *